US007513747B2

(12) United States Patent
Bachofner et al.

(10) Patent No.: US 7,513,747 B2
(45) Date of Patent: Apr. 7, 2009

(54) ROTOR FOR A COMPRESSOR

(75) Inventors: René Bachofner, Untersiggenthal (CH); Pietro Grigioni, Ehrendingen (CH); Wolfgang Kappis, Fislisbach (CH)

(73) Assignee: ALSTOM Technology Ltd., Baden (CH)

( * ) Notice: Subject to any disclaimer, the term of this patent is extended or adjusted under 35 U.S.C. 154(b) by 64 days.

(21) Appl. No.: 11/419,031

(22) Filed: May 18, 2006

(65) Prior Publication Data

US 2006/0228216 A1 Oct. 12, 2006

Related U.S. Application Data

(63) Continuation of application No. PCT/EP2004/053114, filed on Nov. 26, 2004.

(30) Foreign Application Priority Data

Dec. 6, 2003 (DE) ..... 103 57 134

(51) Int. Cl.
*F01D 5/30* (2006.01)

(52) U.S. Cl. ..... 416/215; 416/248

(58) Field of Classification Search ..... 416/215–218, 416/219 R, 220 R, 221, 248
See application file for complete search history.

(56) References Cited

U.S. PATENT DOCUMENTS

| | | | | |
|---|---|---|---|---|
| 1,638,648 A | | 8/1927 | Trotter et al. | |
| 2,010,022 A | | 11/1935 | Holzwarth | |
| 2,414,278 A | | 1/1947 | Soderberg | |
| 2,847,187 A | * | 8/1958 | Murphy | 416/221 |
| 2,925,250 A | | 2/1960 | Whitehead | |
| 3,584,971 A | * | 6/1971 | Ortolano | 416/218 |
| 4,595,340 A | * | 6/1986 | Klassen et al. | 416/193 A |
| 4,875,830 A | | 10/1989 | Trousdell et al. | |

(Continued)

FOREIGN PATENT DOCUMENTS

| | | |
|---|---|---|
| DE | 19615549 | 10/1997 |

(Continued)

OTHER PUBLICATIONS

Search Report for German Patent App. No. 103 57 134.5 (Jul. 26, 2004).

(Continued)

*Primary Examiner*—Christopher Verdier
(74) *Attorney, Agent, or Firm*—Cermak Kenealy Vaidya & Nakajima LLP; Adam J. Cermak

(57) ABSTRACT

A rotor (20) for a compressor, in particular in a gas turbine, has a number of rotor blades (25) which are arranged around the rotation axis of the rotor (20) in the form of a rim and are each held in a circumferential recess (21) on the rotor (20) by a blade root (26), with the blade root (26) having a widening lower part (27) which engages behind two shoulders (24) that are formed on the side walls of the recess (21). In such a rotor, the life is lengthened in that the recess depth (T) of the recess (21) is substantially greater than a minimum recess depth ($T_{min}$) which results in the rotor (20) having sufficient strength in the area of the blade attachment for starting, based on the predetermined material characteristics of the rotor (20) and the operating conditions of the compressor.

4 Claims, 1 Drawing Sheet

U.S. PATENT DOCUMENTS

| | | | | |
|---|---|---|---|---|
| 5,435,694 | A * | 7/1995 | Kray et al. | 416/219 R |
| 5,842,831 | A * | 12/1998 | Galke et al. | 416/95 |
| 5,919,032 | A * | 7/1999 | Naudet et al. | 416/216 |
| 6,065,938 | A * | 5/2000 | Bartsch | 416/219 R |
| 6,183,202 | B1 * | 2/2001 | Ganshaw | 416/219 R |
| 6,832,892 | B2 * | 12/2004 | Murphy et al. | 415/174.2 |
| 2002/0182081 | A1 * | 12/2002 | Bachofner et al. | 416/220 R |

FOREIGN PATENT DOCUMENTS

| | | | | |
|---|---|---|---|---|
| DE | 69800296 | | 3/2001 | |
| SU | 418618 | A * | 8/1974 | 416/221 |
| WO | WO97/49921 | | 12/1997 | |

OTHER PUBLICATIONS

Search Report for PCT Patent App. No. PCT/EP2004/053114 (Mar. 31, 2005).

* cited by examiner

ROTOR FOR A COMPRESSOR

This application is a Continuation of, and claims priority under 35 U.S.C. § 120 to, International application number PCT/EP2004/053114, filed 26 Nov. 2004, and claims priority under 35 U.S.C. § 119 to German application number 103 57 134.5, filed 6 Dec. 2003, the entireties of which are incorporated by reference herein.

BACKGROUND OF THE INVENTION

1. Field of the Invention

The present invention relates to the field of turbomachines, and in particular to a rotor for a compressor.

2. Brief Description of the Related Art

Rotors for high-pressure compressors, as are used in particular in gas turbines, generally have a multistage blade system, which includes blade rims which are arranged one behind the other in the axial direction. Each blade rim contains a large number of rotor blades, which are arranged on and attached to the circumference of the rotor. Each of the rotor blades is seated by means of a blade root in a circumferential groove, which is in the form of a recess in the rotor. One such rotor is known, for example, from the document DE-A1-196 15 549.

Figure 1:
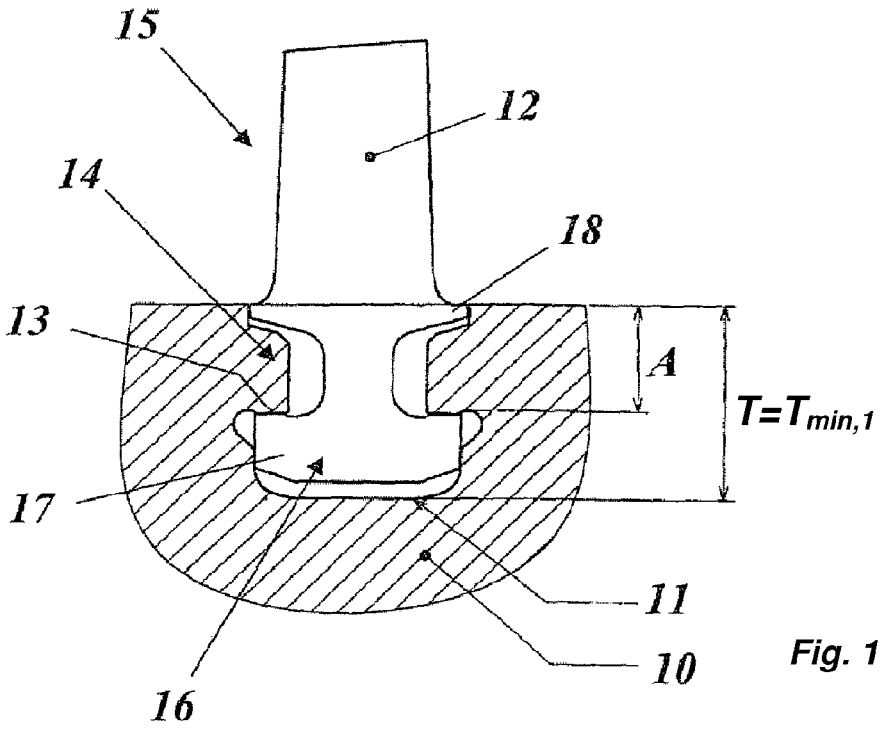
Fig. 1 (Prior Art)

FIG. 1 also shows how a single rotor blade is mounted in a rotor according to the prior art: the rotor blade 15 has a blade section 12 which projects radially outwards and a blade root 16, which are separated from one another by a platform 18. The rotor blade 15 is mounted in the rotor 10 by means of the blade root 16. A circumferential groove, in the form of a recess 11 which has a recess depth T, is provided for attachment of the rotor blades. Shoulders 14 with a shoulder depth A are formed on the side walls within the recess 11. The blade root 16 has a widening lower part 17 with a cross-sectional contour in the form of an inverted "T", by means of which it engages behind the shoulders 14 of the recess 11. The centrifugal force which acts on the rotor blade 15 during rotation of the rotor 10 is in this case transmitted via contact surfaces 13 to the shoulders 14 of the recess 11.

In order to avoid the recesses 11 for the rotor blades weakening the mechanical strength of the rotor any more than necessary, the recesses 11 in the prior art have a minimum recess depth $T=T_{min,1}$. This minimum recess depth $T_{min,1}$ allows the shoulder 14 to have a shoulder depth A which is just sufficient to allow sufficient initial strength of the rotor 10 in the area of the shoulders 14 in the prevailing extreme operating conditions (high rotation speeds, temperatures up to 500° C. ) and with the characteristics of the chosen rotor material.

Now, however, it has been found in practice that the use of a recess with the minimum recess depth $T_{min,1}$ can lead to the rotor 10 being stressed beyond the permissible strength limits in the area of the recess 11, and this can lead to a reduction in the rotor life.

SUMMARY OF THE INVENTION

One aspect of the present invention thus includes providing a rotor for a compressor which addresses this life problem.

Another particularly advantageous aspect of the present invention includes providing the recess with a recess depth which is substantially greater than the minimum recess depth, and to adapt the blade root accordingly.

The recess depth should preferably be more than 10% greater than the minimum recess depth. In particular, it has been proven for the recess depth to be about 40% greater than the minimum recess depth.

One preferred refinement of the invention is characterized in that cutouts are provided in the blade root in order to reduce the weight. This makes it possible to compensate for increases in the weight of the rotor blade resulting from the lengthened blade root, and to reduce the forces which occur during operation.

In one preferred development of the refinement, a cutout is provided in the blade root, above the lower part, in the form of a hole which passes through the blade root in the circumferential direction, with the hole, in particular, being in the form of an elongated hole which extends in the radial direction.

However, it may also be advantageous for cutouts to be provided on the lower face of the lower part of the blade root, in order to reduce the weight.

BRIEF DESCRIPTION OF THE DRAWING FIGURES

Figure 2:
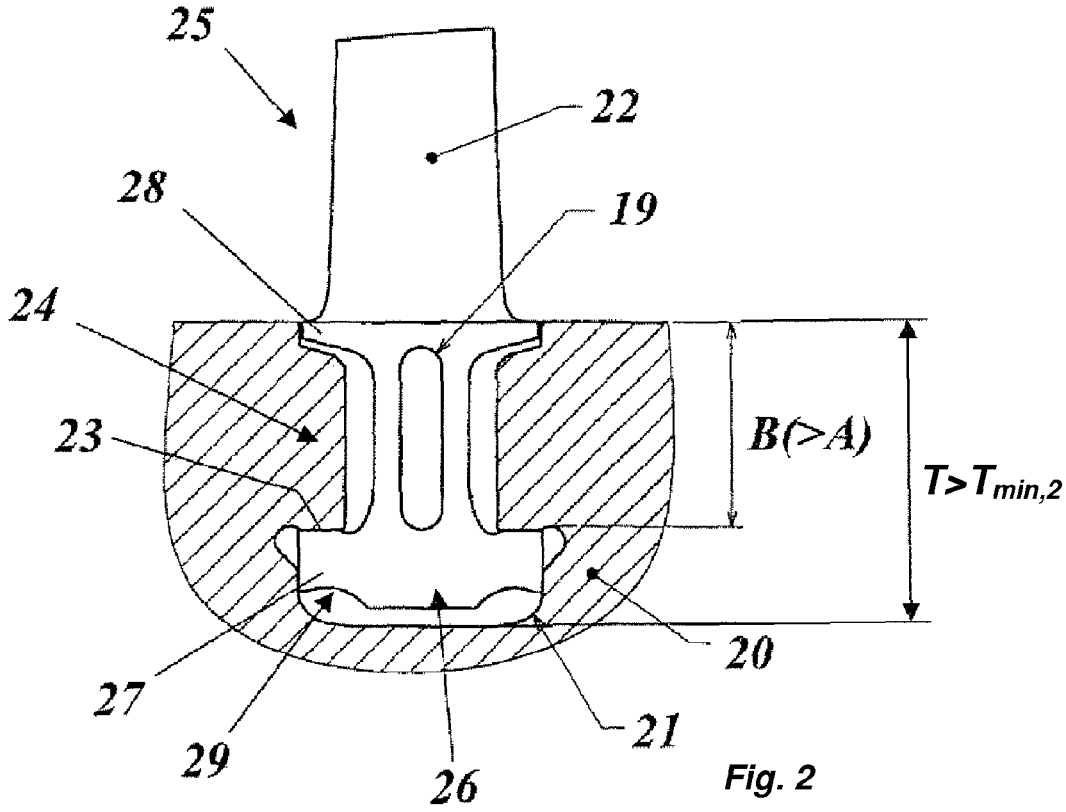

The invention will be explained in more detail in the following text with reference to exemplary embodiments and in conjunction with the drawings, in which:

FIG. 1 shows a longitudinal section, illustrated in the form of a detail, of how a rotor blade is mounted in the rotor of a high-pressure compressor according to the prior art, and FIG. 2 shows an illustration, comparable to that in FIG. 1, of one exemplary embodiment of a rotor blade mounting according to the invention.

DETAILED DESCRIPTION OF EXEMPLARY EMBODIMENTS

In the exemplary embodiment of the invention illustrated in FIG. 2, the rotor blade 25 is mounted in the rotor 20 by the blade section 22, the platform 28 and the blade root 26, by a recess 21. In this case as well, side shoulders 24 are once again formed in the recess 21, behind which the widened lower part 27 of the blade root 26 engages, and is supported on the contact surfaces 23 when centrifugal forces occur.

In order to make it possible to better absorb the load which occurs in this case on the shoulders 24, and thus to overcome the life limit which results from strength problems, the recess 21 is now formed with a recess depth T which is substantially greater, in particular at least, 10% greater, than the minimum recess depth $T_{min,2}$ used in the prior art.

This makes it possible to increase the shoulder depth of the shoulders 24 to a value B which is substantially greater than the shoulder depth A with the already known mounting as shown in FIG. 1. In the exemplary embodiment shown in FIG. 2, the recess depth T is at least, approximately 40% greater than the minimum recess depth $T_{min,2}$, as has been proven in practice.

The increase in the recess depth T and in the shoulder depth B also results in an increase in the height of the blade root 26. Lengthening the blade root 26 necessarily also increases the blade weight, which would lead to increased centrifugal forces and thus to increased mechanical loads on the rotor 20. It is therefore particularly advantageous for at least a portion of the weight increase which is caused by the extension to be counteracted again by suitable measures. The measures comprise material being cut away on the rotor blade 25 in the area of the blade root 26 by the provision of at least one cutout at points which are not critical to the mechanical strength. A first preferred type of cutout is an elongated hole 19, which passes through the blade root 26 in the circumferential direction and extends in the radial direction. The elongated hole 19 is in this case arranged in the thin section of the blade root 26, and is located in the centre, between the two shoulders 24. A second preferred type of cutout is rounded depressions 29, at the edge, on the lower face of the lower part 27 of the blade root 26. Both types of cutouts 19, 29 may optionally be implemented individually or may be combined with one another, in order to achieve the desired reduction in weight by reducing the amount of material.

LIST OF REFERENCE SYMBOLS

10,20 Rotor
11,21 Recess (circumferential groove)
12,22 Blade section
13,23 Contact surface
14,24 Shoulder
15,25 Rotor blade
16,26 Blade root
17,27 Lower part (blade root)
18,28 Platform
19 Elongated hole
29 Depression
A,B Shoulder depth
$T_{min}$ Minimum recess depth
T Recess depth While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A compressor with a rotor, said rotor having predetermined material characteristics and said compressor having predetermined operating conditions, said predetermined material characteristics and operating conditions defining a compressor-specific minimum recess depth for a circumferential, rotor-blade-receiving recess in said rotor, such that the rotor has sufficient initial strength in the area of the blade attachment, said rotor comprising:

a circumferential recess including side walls and two shoulders formed in said side walls, each shoulder having a shoulder depth;

a plurality of rotor blades arranged as a rim around a rotation axis of the rotor, each blade including a blade root which holds the rotor blades in the rotor circumferential recess;

wherein each blade root includes a widening lower part which engages behind the two shoulders of the side walls;

wherein the depth of the recess is at least 10% greater than said compressor-specific minimum recess depth; and wherein the shoulder depth is sized to correspond to the recess depth, and wherein the rotor blade roots are sized to correspond to the recess depth.

2. The compressor as claimed in claim 1, wherein the recess depth is about 40% greater than said compressor-specific minimum recess depth.

3. The compressor as claimed in claim 2, further comprising:

cutouts formed in each blade root to reduce weight, said cutouts each comprising rounded depressions adjacent an edge of each cutout, formed on a lower face of each blade root lower part, each cutout comprising a circumferential hole that passes through the blade root above the lower part.

4. The compressor as claimed in claim 1, further comprising:

cutouts formed in each blade root to reduce weight, said cutouts each comprising rounded depressions adjacent an edge of each cutout, formed on a lower face of each blade root lower part, each cutout comprising a circumferential hole that passes through the blade root above the lower part.

* * * * *